US005130915A

United States Patent [19]

Lerch

[11] Patent Number: 5,130,915

[45] Date of Patent: Jul. 14, 1992

[54] DOME SHAPED LIGHTING FIXTURE

[76] Inventor: Dale W. Lerch, 416 15th St., Modesto, Calif. 95354

[21] Appl. No.: 822,086

[22] Filed: Jan. 17, 1992

[51] Int. Cl.[5] ..... F21S 3/10

[52] U.S. Cl. ..... 362/367; 362/148; 362/360; 362/361; 52/81

[58] Field of Search ..... 52/81; 362/148, 150, 362/352, 360, 361, 367

[56] References Cited

U.S. PATENT DOCUMENTS 3,757,110 9/1973 Soboleski ..... 362/360
4,541,038 9/1985 Van Noord ..... 362/367 X
4,663,898 5/1987 Yacaboni ..... 52/81 X

*Primary Examiner*—Stephen F. Husar
*Attorney, Agent, or Firm*—Charles C. Logan, II

[57] ABSTRACT

A dome shaped decorative lighting fixture that is marketed in kit form with its individual components easily assembled and disassembled. The dome shaped decorative lighting fixture has been designed to be mounted in a ceiling either below a skylight and/or within a housing built into the ceiling. If used in a built-in housing, there would be light fixtures mounted therein which would illuminate the light transmissive panels of the lighting fixture. The panels are held securely in place solely by gravity with each panels H-channel member structure on its respective top and bottom edges interlocking with the adjacent light panels H-channel member structure.

10 Claims, 2 Drawing Sheets

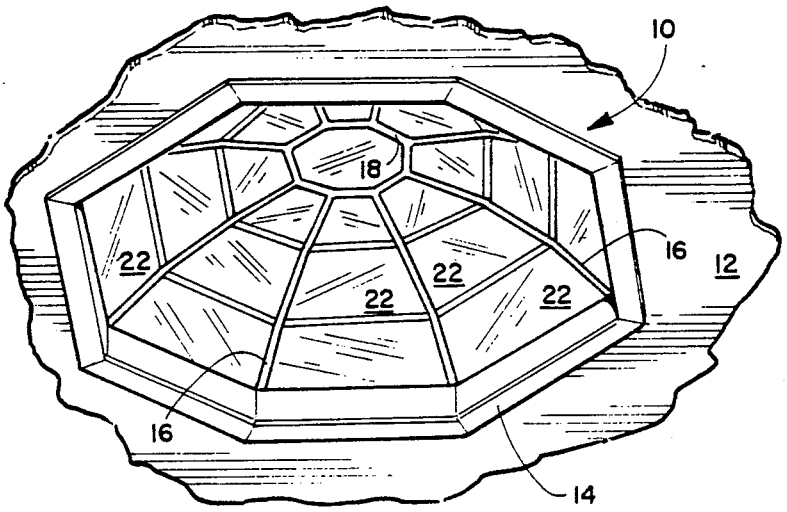
FIGURE 1A
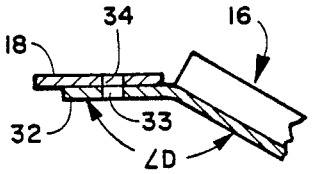
FIGURE 2C
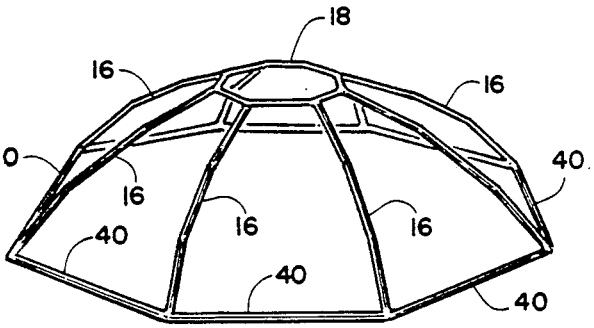
FIGURE 1B
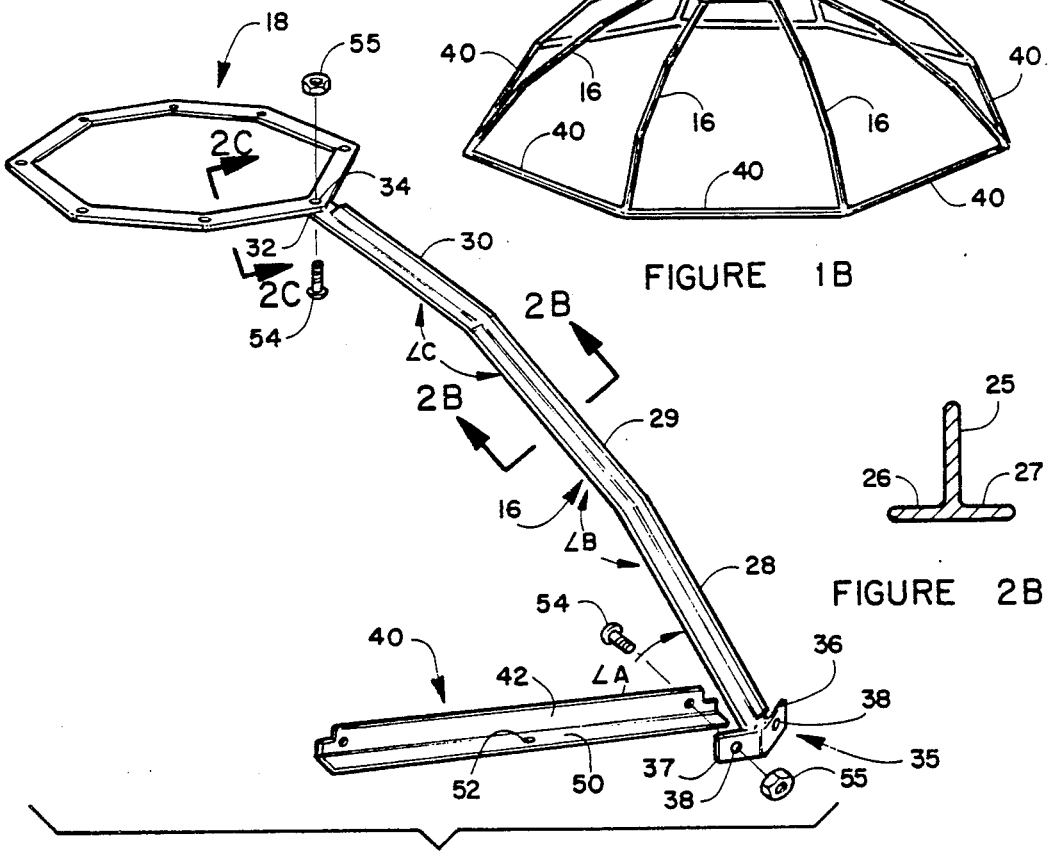
FIGURE 2A
FIGURE 2B

DOME SHAPED LIGHTING FIXTURE

BACKGROUND OF THE INVENTION

The invention relates to decorative lighting fixtures and more specifically to a dome shaped lighting fixture that is mounted in a ceiling either below a skylight and/or within an enclosed housing mounted in the ceiling.

In the past dome shaped decorative lighting fixtures have had frames that are welded in their entirety at their place of manufacture or require expensive welding of the parts at the job-site. A disadvantage of pre-welded dome frames is they are bulky and costly to ship or transport. The size of the dome shaped decorative lighting fixtures that are being discussed are in the range of 4 feet in diameter and larger.

Prior art dome frames have heretofore been manufactured for lighting panels that require the panels to be glazed and/or clipped to hold them in place. This structure made it difficult for removal of the lighting panels for replacement, changing of light bulbs, and/or cleaning, all of which is difficult and time-consuming when the panels are locked into place by glazing and/or clips.

Existing prior art dome frames also utilize horizontal frame ribs between the adjacent spaced vertical ribs of their frames. Additionally, previous dome shaped decorative lighting fixtures do not have interchangeable top plate members such as: (a) a ring shaped type that allows a light panel to be layed thereover, or (b) solid top plates with a small hole for hanging a chandelier or other similar hanging fixture from the center of the dome frame, or (c) a solid top-plate that allows for the addition of recessed down-lighting lamp fixtures to be mounted above the dome shaped decorative lighting fixture itself.

It is an object of the invention to provide a novel dome shaped decorative lighting fixture that can be marketed in kit form so that it may be assembled and installed at the job site.

It is also an object of the invention to provide a novel dome shaped decorative lighting fixture that utilizes a minimal number of mass produced parts that are assembled into the final structure.

It is also an object of the invention to provide a novel dome shaped decorative lighting fixture that is economical to manufacture and market.

It is another object of the invention to provide a novel dome shaped decorative lighting fixture that does not require its components to be welded together and which can also be disassembled.

It is an additional object of the invention to provide a novel dome shaped decorative lighting fixture that utilizes light transmitting panels that do not have to be glazed and/or clipped to hold them in place.

It is a further object of the invention to provide a novel dome shaped decorative lighting fixture that can be used either with a skylight and/or with a light housing that is mounted in the ceiling.

SUMMARY OF THE INVENTION

The dome shaped decorative lighting fixture has been designed with many novel features. It can be marketed in kit form having a minimum number of parts, many of which are identical to each other and which can be mass produced. These parts basically include a top plate, a plurality of dome arms, a plurality of base angle plate, a plurality of light transmitting panels and the required number of nuts and bolts to secure the parts together. The only tools required to assemble the dome shaped decorative lighting fixture are simple tools such as a screw driver and a wrench. Assembly time is minimal.

The dome shaped decorative lighting fixture has been designed for versatile applications. It can be used in a ceiling beneath a skylight. It thus receives the natural light on the top surface of its respective light transmitting panels and passes it into the interior of the room to provide it with natural lighting. The dome shaped decorative lighting fixture can also be used in a minimal height housing that would be built into the ceiling and provided with filament or florescent light bulbs that would indirectly illuminate the light transmitting panels of the dome frame. The unique design of the junction of the ribs to the top ring plate of the dome shaped lighting fixture provides for a tight light seal (eliminating light seepage at this junction), which eliminates the need for any sealing material. This is accomplished by having the tongue attached to the top end of the dome arms in the manner illustrated in the drawings.

The top plate has been designed to be interchangeable for providing different functions. An open center top plate in the shape of a ring allows for a lighting panel to be laid over the hole. By using a solid top plate with a small hole in its center, a chandelier or other similar hanging fixture can be hung from the center of the dome frame. A solid top plate with a large center hole also allows for the addition of recessed down-lighting lamp fixtures such as spotlights and floodlights. The down lighting fixtures would be mounted on the top of the top plate.

The dome shaped lighting fixture illustrated in the drawing is octogonal, having eight arms, eight angle plates, and a top plate. The principles involved permit the construction of any dome size or shape starting with a triangle as long as the same number of arms and angle plates are used. More common shapes would have 6,8,10,12, 16,20, etc. sides to the dome frame. The number of light transmitting panels stacked upon each other between the adjacent dome arms can also be more or less than the illustrated three panels per side.

DESCRIPTION OF THE DRAWINGS

FIG. 1A is a bottom perspective view of an assembled novel dome shaped decorative lighting fixture;

FIG. 1B is a front perspective view of the dome frame;

FIG. 2A is a front perspective view of one of the dome arms and the top ring;

FIG. 2B is a cross sectional view taken along lines 2B—2B of FIG. 2A;

FIG. 2C is a cross sectional view taken along lines 2C—2C of FIG. 2A;

DESCRIPTION OF THE PREFERRED EMBODIMENT

Figure 3:
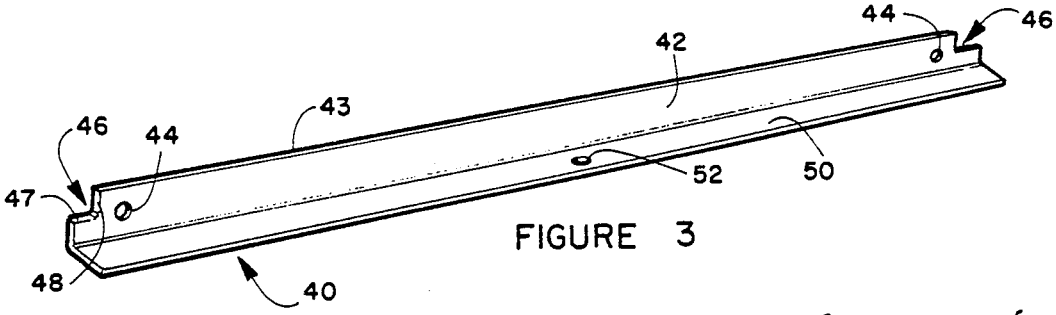
FIG. 3 is a front perspective view of one of the angle plates.
Figure 4:
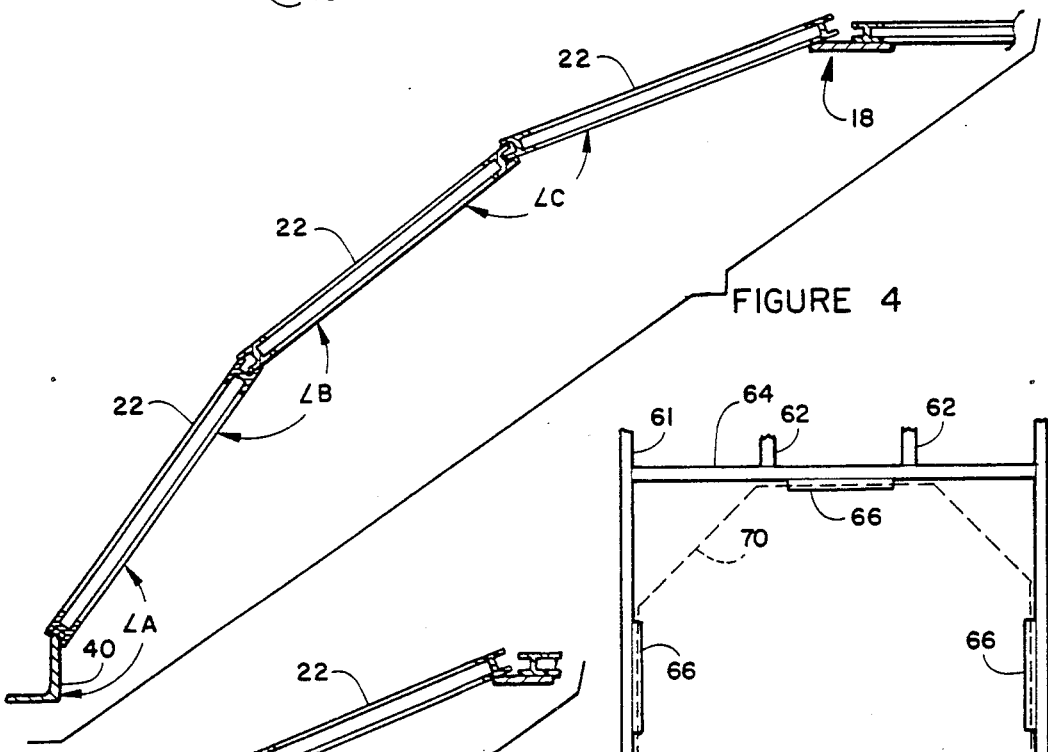
FIG. 4 is a cross sectional view taken along lines 4—4 of FIG. 6 illustrating how the light transmitting panels are supported in interlocking fashion with each other.

The novel dome shaped decorative lighting fixture will now be described by referring to FIGS. 1-7. The lighting fixture is generally designated numeral 10 and it is seen in FIG. 1A in its assembled state as mounted within a ceiling 12 and surrounded by trim molding 14. The dome shaped decorative lighting fixture 10 has a plurality of substantially identical dome arms 16 whose top ends are secured to a top plate 18 by bolts 54 and nuts 55 and whose bottom ends are secured to angle plates 40 by bolts 54 and nuts 55 as shown in FIG. 2A. A plurality of light transmissive panels 22 having a trapezoidal shape are supported in a manner later to be described.

The configuration of dome arms 16 is best understood by referring to FIG. 2A. It is formed from a plurality of sections each having a longitudinal axis. The longitudinal axis of bottom section 28 intersects the longitudinal axis of middle section 29 at an obtuse angle B. The longitudinal axis of middle section 29 intersects the longitudinal axis of top section 30 at an obtuse angle C. In its assembled state, bottom section 28 is inclined upwardly at an acute angle A that is always less than 90 degrees. A tongue member 32 is welded to the top end of dome arm 16 at an angle D (see FIG. 2C) and it has an aperture 33 therein that mates with aperture 34 in top plate 18 in such a fashion that the plane of the top light transmissive panels 22 touches the edge of top plate 18 to precisely form a tight light seal (see FIG. 4). A bracket 35 is welded to the bottom end of dome arm 16 and it has a left side 37 and a right side 36. Apertures 38 are formed adjacent the respective edges. Dome arm 16 has an inverted T-shaped cross section formed by upright wall 25 (see FIG. 2B) and lateral flanges 26 and 27.

Angle plates 40 have a vertical wall portion 42 having a top edge 43 (see FIG. 3). They have a pair of apertures 44 adjacent their opposite ends. Relieved portions 46 are formed by horizontal edges 47 and vertical edges 48 adjacent the respective ends of vertical wall portion 42. Horizontal wall portion 50 has an aperture 52.

Figure 5:
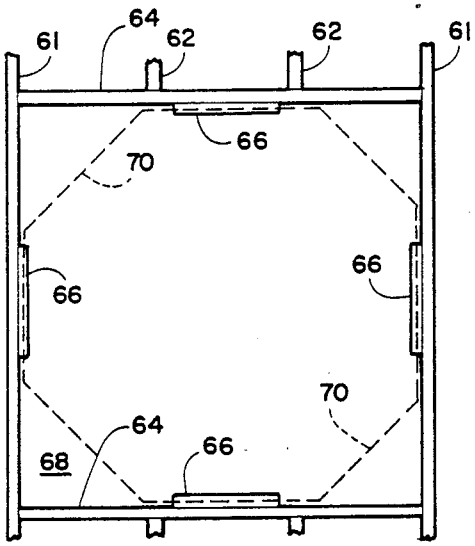
FIG. 5 is a top plan view of mounting structure for the dome shaped decorative lighting fixture showing how it can be mounted in a housing in a ceiling.
Figure 6:
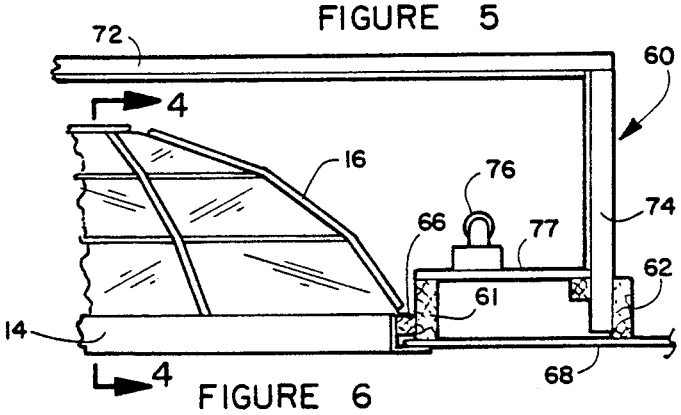
FIG. 6 is a partial vertical sectional view showing the dome shaped decorative lighting fixture mounted in a ceiling housing.

In FIGS. 5 and 6 the dome shaped decorative lighting fixture is shown mounted in a housing 60 (see FIG. 6) above the ceiling 12 (see FIG. 1A). The ceiling has the standard ceiling joists 61 and 62 (see FIG. 5) that are typically spaced from each other on 16 inch centers. Cross members 64 would be mounted transversely to the outer joists 61. Frame rests 66 would be 2×2's attached to the respective joist and cross members 61 and 64. Sheetrock 68 would be cut along lines 70 for the octagonal shaped dome frame that is illustrated in the drawings.

Housing 60 has a top wall 72 and side walls 74. Light fixtures such as fluorescent fixture 76 would be mounted on panel 77. Trim moulding 14 hides the respective frame rests 66 from view. It is on frame rest 66 that angle plates 40 are secured by nails or screws passing through apertures 52 (see FIG. 2A).

Figure 7:
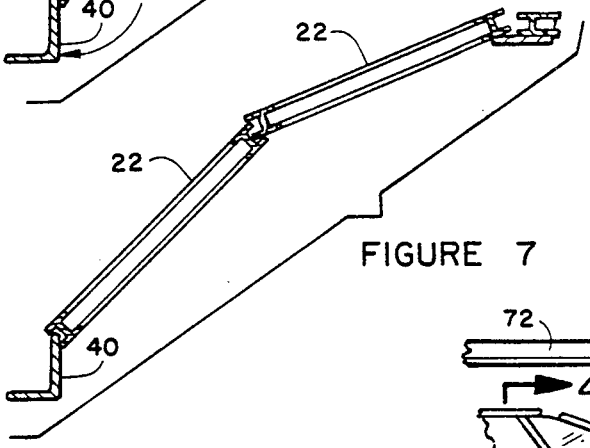
FIG. 7 is a side elevational view of an alternative embodiment dome arm having only two sections.

In FIG. 7 an alternative embodiment of a dome shaped lighting fixture is illustrated.

What is claimed is:

1. A dome shaped decorative lighting fixture comprising:

a horizontally oriented top plate having a peripheral edge;

a plurality of substantially identical dome arms each having a predetermined length, a top end, and a bottom end;

said dome arms having an inverted T-shaped cross section formed by a central upright wall and laterally extending flanges;

said dome arms being formed of at least two sections each having a longitudinal axis and these longitudinal axes intersect each other at an obtuse angle, one of these sections would be a top section and one would be a bottom section;

means adjacent the top end of said dome arms for detachably securing them to the edge of said top plate;

a plurality of horizontally oriented elongated angle plates each having a vertical top wall portion and a horizontal wall portion, said angle plates each having a left end and a right end;

means for detachably securing the bottom ends of said dome arms to said angle plates;

a plurality of light transmissive panels each having a substantially trapezoidal shape having a top edge, a bottom edge, a left edge and a right edge;

means on the bottom edges of some of said light transmissive panels for detachably interlocking with the vertical wall portion of said angle plates;

means on the top edges of some of said light transmissive panels for detachably interlocking with the bottom edges of some of said light transmissive panels; and said dome shaped light fixture in its assembled state having the respective right and left edges of said light transmissive panels entirely supported on and in contact with the lateral flanges of said dome arms solely by gravity.

2. A dome shaped decorative lighting fixture as recited in claim 1 wherein said top plate is ring-shaped.

3. A dome shaped decorative lighting fixture as recited in claim 1 wherein said means for detachably securing the top end of said dome arms to said top plate comprises: a tongue member having an aperture therein extending from the top end of each of said dome arms that aligns with apertures in said top plate and a bolts and nuts for detachably securing the respective members together.

4. A dome shaped decorative lighting fixture as recited in claim 1 wherein said dome arms each have a middle section whose longitudinal axis intersects the longitudinal axes of said respective top and bottom sections at obtuse angles.

5. A dome shaped decorative lighting fixture as recited in claim 1 wherein said means for detachably securing the bottom ends of said dome arms to said angle plates comprises: laterally extending brackets secured to the bottom ends of said dome arms, said brackets having a left edge and a right edge with apertures adjacent these edges and these apertures align with apertures in the vertical wall portion of said angle plates, and bolts and nuts for detachably securing the respective members together.

6. A dome shaped decorative lighting fixture as recited in claim 1 wherein said means for detachably interlocking said light transmissive panels to the vertical wall portion of said angle plates is the H-shaped channel member secured to the bottom edge of said light transmissive panel.

7. A dome shaped decorative lighting fixture as recited in claim 1 wherein said means for detachably interlocking the respective top and bottom edges of some of said light transmissive panels together is the H-shaped channel member secured to the respective top and bottom edges of said light transmissive panels.

8. A dome shaped decorative lighting fixture as recited in claim 1 wherein its structure is mounted in a ceiling having a sky-light mounted overhead.

9. A dome shaped decorative lighting fixture as recited in claim 1 wherein its structure is mounted in a ceiling within a housing that has a light fixture mounted therein.

10. A dome shaped decorative lighting fixture as recited in claim 1 wherein the entire structure is packaged as individual members in a kit for assembly.

* * * * *